US008382275B2

(12) United States Patent
Maekawa

(10) Patent No.: US 8,382,275 B2
(45) Date of Patent: Feb. 26, 2013

(54) PRINTER

(75) Inventor: Hironori Maekawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 242 days.

(21) Appl. No.: 12/711,916

(22) Filed: Feb. 24, 2010

(65) Prior Publication Data

US 2011/0205322 A1 Aug. 25, 2011

(30) Foreign Application Priority Data

Feb. 23, 2010 (JP) ..... 2010-036949

(51) Int. Cl.
*B41J 2/01* (2006.01)

(52) U.S. Cl. ..... 347/104; 347/84; 347/85; 347/102; 400/642; 400/656

(58) Field of Classification Search ..... None
See application file for complete search history.

(56) References Cited

U.S. PATENT DOCUMENTS

| | | | | |
|---|---|---|---|---|
| 5,820,283 | A * | 10/1998 | Sunada et al. | 400/642 |
| 6,789,890 | B2 * | 9/2004 | Bruhn et al. | 347/104 |
| 2002/0047885 | A1 * | 4/2002 | Miyawaki et al. | 347/104 |
| 2003/0025777 | A1 * | 2/2003 | Sugiyama | 347/104 |
| 2004/0174421 | A1 * | 9/2004 | Tsuji | 347/104 |
| 2005/0168557 | A1 * | 8/2005 | Ohyama | 347/104 |
| 2007/0291096 | A1 * | 12/2007 | Toyoshima | 347/104 |
| 2009/0147065 | A1 | 6/2009 | Maekawa et al. | |
| 2009/0278873 | A1 | 11/2009 | Motoyama et al. | |

FOREIGN PATENT DOCUMENTS

| | | | |
|---|---|---|---|
| JP | 2001-212946 | A | 8/2001 |
| JP | 3864791 | B2 | 1/2007 |
| JP | 2009-101652 | A | 5/2009 |
| JP | 2009-126034 | A | 6/2009 |
| JP | 2009-269295 | A | 11/2009 |

* cited by examiner

*Primary Examiner* — Matthew Luu
*Assistant Examiner* — John P Zimmermann
(74) *Attorney, Agent, or Firm* — Kilpatrick Townsend & Stockton LLP

(57) ABSTRACT

A printer is provided that can convey recording paper at a constant transportation speed and transportation amount passed a printing position by means of the transportation force of a single transportation roller pair located on the upstream side of the printing position.

A roll paper printer has a vacuum type platen member opposite the ink nozzle surface of an inkjet head, and an upstream guide surface and a platen surface that defines the printing position are formed on the guide surface of the platen member. The upstream guide surface extends to a position near the nipping part of the single transportation roller pair on its upstream side. Because the recording paper fed from the nipping part toward the printing position is guided while being constrained by air suction to the upstream guide surface, deflection in the out-of-plane direction is suppressed and the recording paper is held flat. The recording paper can be conveyed with good precision to the printing position using only the transportation force of the single transportation roller pair disposed on the upstream side.

5 Claims, 5 Drawing Sheets

PRINTER

This application claims priority to Japanese Patent Application No. 2010-036949, filed Feb. 23, 2010, the entirety of which is incorporated by reference herein.

TECHNICAL FIELD

The present invention relates to a printer that has a vacuum platen that conveys while pulling the recording paper to the platen surface defining the printing position by air suction. More particularly, the invention relates to a printer that is suitable for conveying recording paper passed a printing position to the paper exit using the transportation force of a transportation roller pair disposed on the upstream side of the platen.

RELATED ART

Holding the recording paper tight to the platen surface that defines the printing position and assuring a precise platen gap (the distance from the print head to the recording paper (behind which the platen is located)) is important as a means of assuring print quality in an inkjet printer. In order to convey while holding the recording paper to the platen surface, a vacuum platen that conveys while pulling the recording paper to the platen surface by means of air suction may be used. More particularly, because continuous recording paper pulled from a paper roll has a natural curl and curls up easily, and fanfold paper has a fold and tends to buckle up at the fold, a vacuum platen is preferably used to forcibly hold the recording paper flat. Printers having a vacuum platen are taught in patent documents 1 and 2.

Roll paper printers that print to recording paper pulled off a paper roll and have a so-called drop-in type of roll paper storage mechanism enabling easily replacing the roll paper are known from the literature. With this type of roll paper storage mechanism an access cover to the recording paper storage unit is opened and the roll paper is simply placed on its side on a roll paper holding tray that defines the bottom of the roll paper storage unit. When the roll paper is then conveyed, the roll paper is pulled from the paper roll while the roll paper rotates on the roll paper holding tray in conjunction with rotation of a transportation roller pair. Therefore, compared with a configuration in which the roll paper is pulled from a paper roll that is loaded so that it rotates on a center spindle, the large inertial load of the paper roll that works when the roll paper is pulled from the roll results in great variation in the transportation load of the roll paper on the transportation roller pair. So that the roll paper feed precision does not drop due to slipping between the transportation roller pair and the recording paper caused by variation in the transportation load, a tension mechanism, for example, may be used to buffer the variation in tension applied to the conveyed recording paper. Roll paper printers that have a vacuum platen and a drop-in type roll paper storage mechanism are taught in patent documents 3 to 5.

PATENT DOCUMENTS

Patent document 1: Japanese Unexamined Patent Appl. Pub. JP-A-2001-212946

Patent document 2: Japan Patent No. 3864791

Patent document 3: Japanese Unexamined Patent Appl. Pub. JP-A-2009-269295

Patent document 4: Japanese Unexamined Patent Appl. Pub. JP-A-2009-126034

Patent document 5: Japanese Unexamined Patent Appl. Pub. JP-A-2009-101652

SUMMARY OF INVENTION

Problem to be Solved by the Invention

Printers such as roll paper printers typically have a transportation roller pair disposed both before and after the printing position of the print head, and thereby convey the recording paper passed the printing position with good precision. Particularly in a roll paper printer with a drop-in type roll paper storage mechanism, the roll paper transportation speed and distance can be easily disrupted because the variation in the transportation load acting on the transportation roller pair is great due to the inertial load of the recording paper. As a result, two transportation roller pairs disposed before and after the printing position are used to convey the recording paper at a constant transportation speed and transportation distance without the part of the recording paper passing the printing position being affected by changes in the transportation load.

If the recording paper could be conveyed with good precision using only a single transportation roller pair instead of two transportation roller pairs, it would be advantageous in terms of both device size and production cost. Particularly in a printer such as a roll paper printer that prints on continuous paper, there is limited space on the downstream side of the printing position because space is required for a recording paper cutting mechanism. Therefore, if the downstream side transportation roller pair could be omitted, greater freedom can be advantageously achieved for the layout of other parts.

However, with a transportation mechanism that conveys recording paper through the transportation path passed the printing position using only the paper feed force of a transportation roller pair disposed on the upstream side of the printing position, recording paper with low out-of-plane stiffness, that is, weak, easily pliable paper, is easily buckled in the out-of-plane direction by the transportation force of the transportation roller pair, and feeding the recording paper at a constant speed and amount to the printing position is difficult. Furthermore, because the variation in the transportation load is great in a roll paper printer having a drop-in type roll paper storage mechanism, the recording paper transportation speed and amount are easily greatly disrupted, and conveying the recording paper with good precision using only a single transportation roller pair is difficult. In addition, when conveying curled recording paper pulled from a paper roll, and when conveying fanfold paper with a fold or perforation, the recording paper fed from the transportation roller pair buckles easily at the curled portion or the folded part of the paper, and feeding the recording paper at a constant speed to the printing position is difficult.

With consideration for the foregoing points, an object of the present invention is to provide a printer that can convey recording paper with good precision passed the printing position by means of the transportation force of a single transportation roller pair disposed on the upstream side of the printing position.

Means of Solving the Problem

To solve the foregoing problem, a printer according to the present invention comprising:

an inkjet head;

a transportation roller pair disposed at a position on the upstream side in the recording paper transportation direction from a printing position of the inkjet head; and a recording paper guide mechanism that guides recording paper fed from the transportation roller pair along a transportation path passed the printing position by means of the feed force of the transportation roller pair;

the recording paper guide mechanism having a guide member having a guide surface that defines the transportation path, and a vacuum unit that constrains the recording paper and suppresses deflection in an out-of-plane direction by holding the recording paper conveyed along the guide surface to the guide surface by means of air suction; and the guide surface including at least a platen surface defining the printing position, and an upstream side guide surface that is contiguous to the platen surface and extends to near the nipping part of the transportation roller pair.

By conveying while holding the recording paper to the guide surface by air suction, the invention constrains the recording paper and suppresses out-of-plane deflection. As a result, the recording paper is held in a similar state as so-called stiff (high rigidity) recording paper. More specifically, the guide surface has an upstream side guide surface that goes from near the nipping part of the transportation roller pair to the platen surface that defines the printing position. Therefore, because the recording paper fed from the transportation roller pair is conveyed while held by air suction to the upstream side guide surface, the recording paper is conveyed at a constant paper feed rate and at a constant paper feed amount toward the printing position without buckling. The end of the upstream side guide surface that pulls the recording paper thereto by air suction and the nipping part of the transportation roller pair are disposed immediately adjacent so that the distance therebetween is short. In other words, because the distance in which the recording paper is not constrained is short, out-of-plane deflection of the recording paper conveyed from the upstream side transportation roller pair can be suppressed. Because the recording paper passed to the platen surface is conveyed while being pulled by air suction to the platen surface and constrained, the platen gap is held constant. As a result, the invention enables conveying recording paper at a constant paper feed rate passed the printing position by means of the transportation force of a single transportation roller pair disposed on the upstream side of the printing position.

A platen member having a platen surface disposed opposite the inkjet head, and an upstream side guide member having an upstream side guide surface, may be disposed as a guide member, but the guide member is preferably a single part in order to reduce the parts count and simplify the construction. In this configuration the upstream side guide member may be rendered in unison with the platen member having the platen surface.

In addition, in order to reduce sliding friction between the guide surface that guides the recording paper and the recording paper that is conveyed while pulled thereto by air suction, the guide surface is preferably rendered by the top surfaces of a plurality of ribs that extend in the recording paper transportation direction, reducing the sliding area therebetween. In this configuration a suction hole for the vacuum unit may be formed in the channel bottom between adjacent ribs.

Note, further, that a downstream side guide surface that is contiguous to the platen surface and extends from the platen surface to a specific position on the downstream side in the recording paper transportation direction from the platen surface may be disposed to an air suction type guide surface.

Next, the present invention is suitable for use in a roll paper printer having a drop-in type roll paper storage mechanism. More specifically, the invention is suited for use in a roll paper printer that has a roll paper storage unit having a roll paper holding tray on which roll paper composed of a continuous web of recording paper wound in a roll is placed so that the roll paper can rotate, the recording paper being pulled by the transportation roller pair while the roll paper rolls on the roll paper holding tray. Compared with a configuration in which the roll paper is held on a spindle and the recording paper is pulled off while the roll paper rotates on a fixed axis of rotation, there is great variation in the transportation load (variation in the pulling force of the recording paper) that works on the transportation roller pair due to the inertial load of the roll paper in a drop-in type roll paper storage mechanism, the paper feed speed and transportation distance of the recording paper that is fed from the transportation roller pair therefore fluctuates, and part of the fed recording paper easily goes slack. Because the part of the recording paper that is fed from the transportation roller pair is constrained by air suction to the upstream side guide surface and is held flat with buckling suppressed by means of the invention, disruption of the paper feed speed and transportation distance of the recording paper that is fed toward the printing position can be suppressed.

To reliably prevent slipping between the transportation roller pair and the recording paper due to variation in the transportation load and the resulting disruption in the recording paper feed speed, the printer preferably also has a load variation suppression unit that suppresses variation in the transportation load of the recording paper acting on the transportation roller pair. Yet further, to suppress variation in the transportation load on the transportation roller pair, a feed roller pair is preferably disposed on the upstream side in the transportation direction from the transportation roller pair.

Furthermore, the guide member is preferably connected to the access cover so that the guide member opens and closes in conjunction with an access cover that opens and closes a roll paper loading opening to the roll paper storage unit, and moves to a closed position opposite the inkjet head and an open position separated from the inkjet head. If thus configured, a space between the inkjet head and the guide member disposed opposite thereto opens when the access cover opens, and the recording paper can be easily loaded through this space.

Likewise, if one roller of the transportation roller pair is mounted on the guide member, and the other roller of the transportation roller pair is installed at a fixed position on the printer case side, a space between the rollers of the transportation roller pair opens when the access cover is opened, and the recording paper can be easily loaded through this space. Furthermore, the configuration on the access cover side is simplified because a separate transportation roller pair does not need to be located near the paper exit.

Effect of the Invention

In a printer according to the present invention an upstream side guide surface is formed in the area from near the nipping part of a single transportation roller pair located on the upstream side of the printing position to the platen surface defining the printing position, and guides the recording paper fed from the nipping part toward the printing position along the upstream side guide surface while pulling the recording paper by air suction to the upstream side guide surface. Because the recording paper is pulled and constrained to the upstream side guide surface by air suction and is thus guided flat, out-of-plane deflection thereof is suppressed and the recording paper does not buckle even when subject to the transportation force of the transportation roller pair. The end of the upstream side guide surface that pulls the recording paper thereto by air suction and the nipping part of the transportation roller pair are disposed immediately adjacent so that the distance therebetween is short. In other words, because the distance in which the recording paper is not constrained is short, out-of-plane deflection of the recording paper conveyed from the upstream side transportation roller pair can be suppressed. Recording paper can therefore be conveyed along the transportation path passed the printing position with good precision by the transportation force of a transportation roller pair on the upstream side instead of conveying the recording paper by means of two transportation roller pairs disposed before and after the printing position. As a result, the downstream side transportation roller pair can be omitted, which is advantageous in terms of device size and manufacturing cost, and other benefits, such as increasing freedom in the parts layout downstream from the printing position, can be obtained.

Particularly when conveying continuous paper such as roll paper or fanfold paper as the recording paper, the recording paper may buckle where the paper is curled or where the paper is folded as the paper is fed from the nipping part of the transportation roller pair and passed to the platen surface, and the transportation speed of the recording paper passing the printing position may be disrupted. In the case of label paper having labels affixed to a liner, buckling can also be suppressed where the liner buckles easily between labels. Because the part of the transportation path from a position near the nipping part to the platen surface is defined by a vacuum type upstream side guide surface, buckling of recording paper that is curled or has folds can be reliably suppressed and recording paper can be conveyed with good precision by means of the present invention.

DESCRIPTION OF PREFERRED EMBODIMENTS

A preferred embodiment of a printer having a recording paper guide mechanism according to the present invention is described below with reference to the accompanying figures. Note that while the following description applies to an embodiment applying the present invention to a roll paper printer, the invention can also be applied to printers other than roll paper printers.

Figure 1:
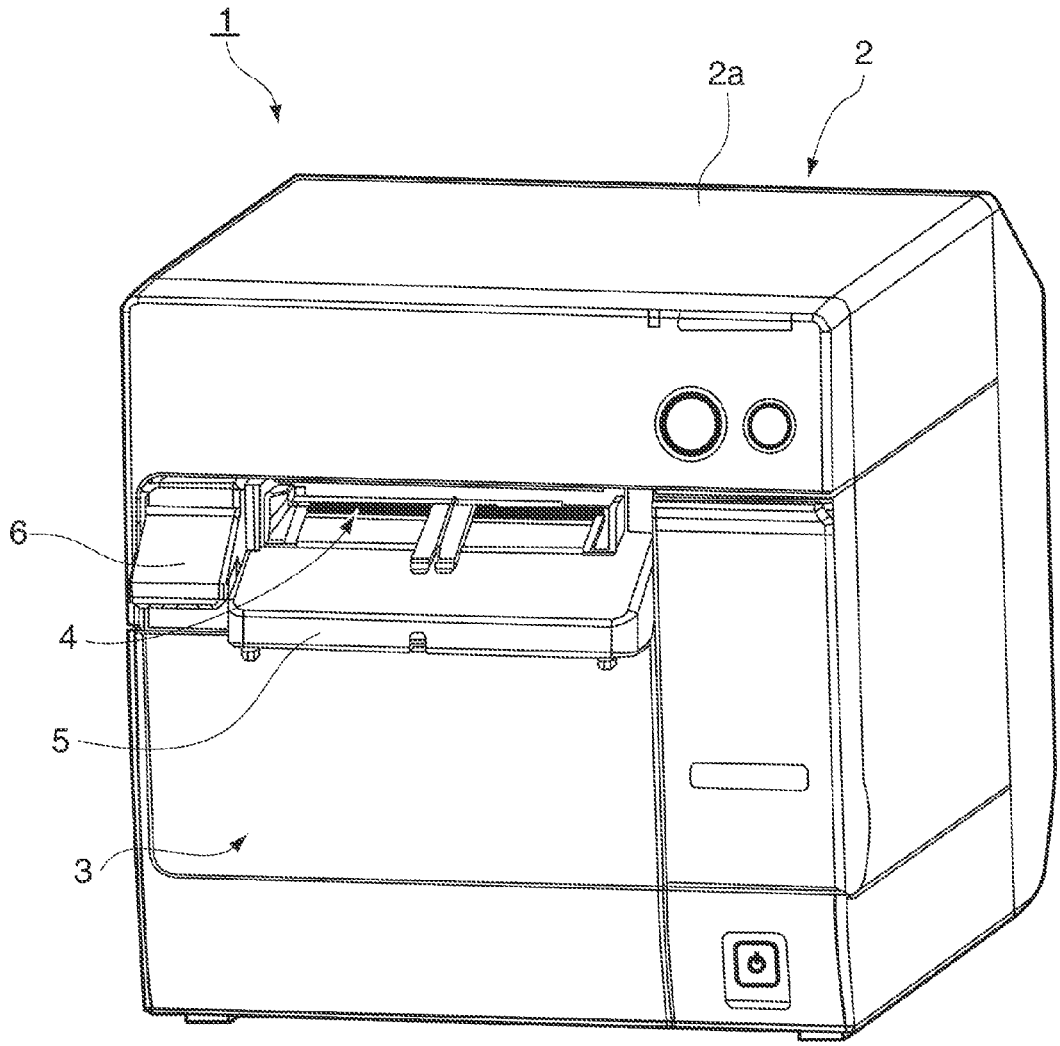
FIG. 1 is an external oblique view of a roll paper printer according to the invention.
Figure 2:
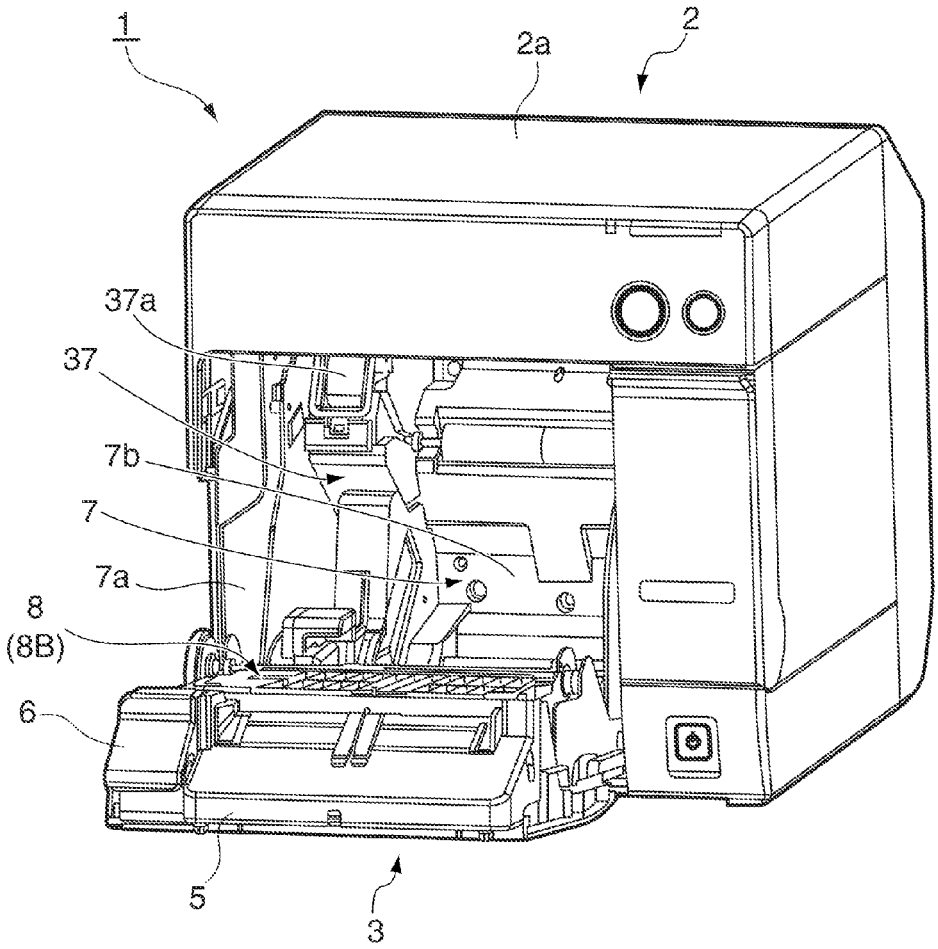
FIG. 2 is an external oblique view of the roll paper printer with the access cover open.

FIG. 1 is an external oblique view of an inkjet roll paper printer according to a first embodiment of the invention, and FIG. 2 is an external oblique view of the printer with the access cover completely open. The roll paper printer 1 has a rectangular box-like body 2 and an opening and closing access cover 3 disposed to the front of the body 2. A paper exit 4 of a specific width is formed at the front of the outside case 2*a* of the printer body 2. An exit guide 5 projects to the front from the bottom side of the paper exit 4, and a cover opening/closing lever 6 is disposed beside the exit guide 5. A rectangular opening 7*a* for loading and removing roll paper in the roll paper storage unit 7 rendered inside the printer case 2 is formed in the outside case 2*a* below the exit guide 5 and cover opening/closing lever 6, and this opening 7*a* is closed by the access cover 3.

When the cover opening lever 6 is operated, the access cover 3 lock (not shown in the figure) is released. When the lock is released and the exit guide 5 disposed to the access cover 3 is pulled forward, the access cover 3 pivots at the bottom end thereof and opens forward to a substantially horizontal position as shown in FIG. 2. When the access cover 3 opens, the opening 7*a* to the roll paper storage unit 7 opens. The roll paper storage unit 7 is a drop-in type transportation path storage structure, and the roll paper 9 (see FIG. 3) may be simply placed on its side on the roll paper holding tray 7*b* that is the bottom of the roll paper storage unit 7. The vacuum platen unit 8 (platen member) that defines the printing position also moves with the access cover 3, and the recording paper transportation path from the roll paper storage unit 7 to the paper exit 4 also open. This enables easily replacing the roll paper 9 from the front of the printer.

Figure 3:
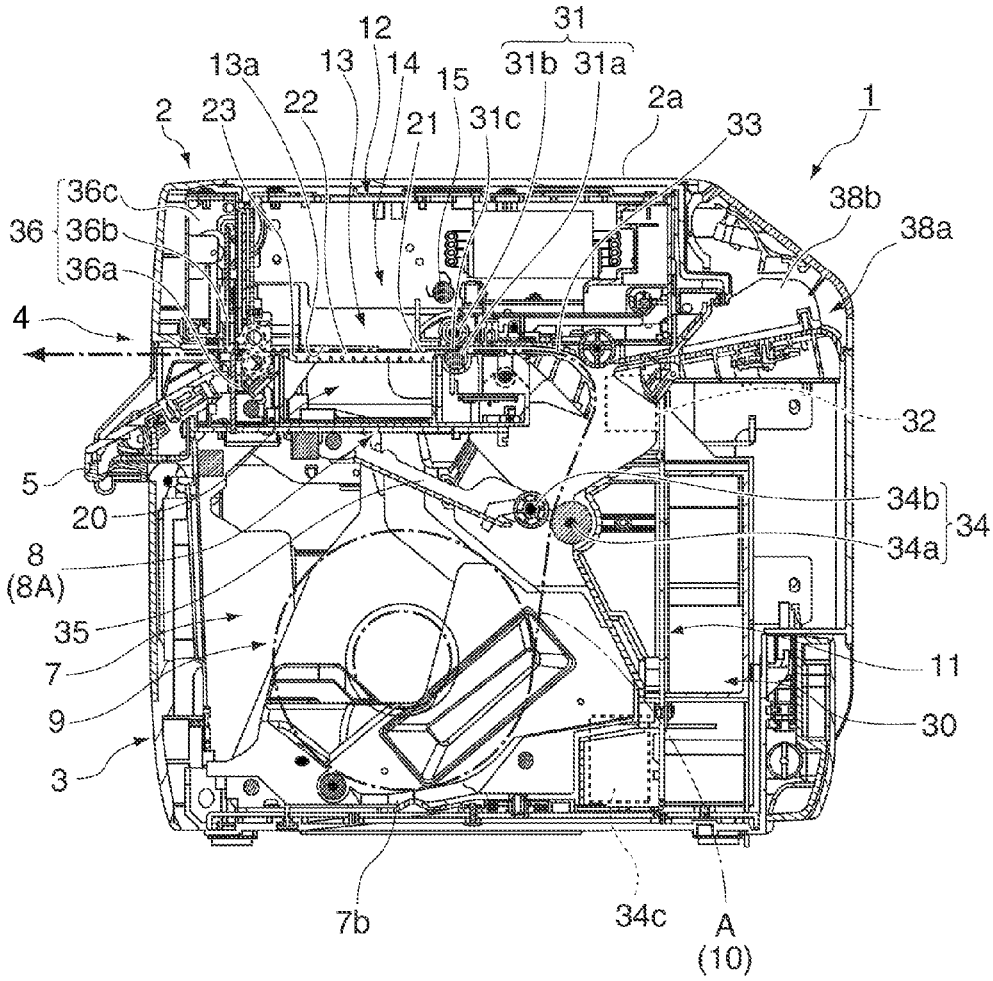
FIG. 3 is a schematic vertical section view of the roll paper printer.

FIG. 3 is a schematic vertical section view showing the internal configuration of the roll paper printer 1. The printer case 2 of the roll paper printer 1 is a construction having various component parts of the printer disposed to a sheet metal printer frame 11 and covered by an outside case 2*a*. The roll paper storage unit 7 is formed inside the printer case 2 in the middle of the width, and the roll paper 9 is placed on its side facing the printer width on the roll paper holding tray 7*b* that defines the bottom of the roll paper storage unit 7.

The platen unit 8 is disposed extending in the front-to-back direction of the printer above the roll paper storage unit 7, and a head unit 12 is disposed above the platen unit 8. Assembled in the head unit 12 are a carriage 14 on which the inkjet head 13 is mounted, a carriage guide shaft 15 that guides the carriage 14 widthwise to the printer, and a carriage drive mechanism (not shown in the figure) that moves the carriage 14 bidirectionally along the carriage guide shaft 15. The inkjet head 13 is mounted on the carriage 14 with the ink nozzle surface 13*a* thereof facing down. The carriage guide shaft 15 is disposed extending widthwise to the printer. The carriage drive mechanism is a configuration that transmits torque from a carriage motor (not shown in the figure) through a timing belt (not shown in the figure) to the carriage 14.

The platen unit 8 is disposed as described above below the down-facing ink nozzle surface 13*a* of the inkjet head 13. A vacuum platen member 20 is attached to the platen unit 8 extending widthwise to the printer. As described below, the vacuum platen member 20 has a guide surface 24 having an upstream guide surface 21, a platen surface 22, and a downstream guide surface 23 rendered on the same plane (see FIG. 4 and FIG. 5). The platen surface 22 is in a position opposing the ink nozzle surface 13*a* of the inkjet head 13 with a constant gap therebetween, and defines the printing position of the inkjet head 13. A centrifugal fan 30 that renders a vacuum unit that produces negative pressure for drawing air and pulling the recording paper 10 conveyed over the upstream guide surface 21, platen surface 22, and downstream guide surface 23 of the vacuum platen member 20 to said surfaces is affixed behind the roll paper storage unit 7.

Next, a transportation roller pair 31 is disposed extending widthwise to the printer behind the upstream guide surface 21 of the platen unit 8. The transportation roller pair 31 includes a drive-side roller 31*a* and a driven-side pressure roller 31*b* that is pressed with specific pressure to the drive-side roller 31*a* with the recording paper therebetween. The drive-side roller 31*a* is mounted on the platen unit 8, and the pressure roller 31*b* is mounted on the printer frame 11 side. The drive-side roller 31*a* is driven rotationally by a transportation motor 32 that is mounted on the printer frame 11 side.

A tension guide 33 that curves down is disposed at a position behind the transportation roller pair 31 of the platen unit 8. The tension guide 33 can pivot down on the front end part thereof, and is urged upward by the force of a spring not shown. Variation in the tension pulling on the recording paper 10 is suppressed because the tension guide 33 moves up and down according to variation in the pulling tension on the recording paper 10 pulled from the roll paper 9. In other words, the tension guide 33 functions as a load variation suppression unit that suppresses variation in the transportation load of the recording paper 10 on the transportation roller pair 31.

A feed roller pair 34 is disposed extending widthwise to the printer below the tension guide 33. The feed roller pair 34 is for feeding recording paper 10 from the roll paper 9, and includes a drive-side roller 34*a* and a driven-side pressure roller 34*b* that is pressed against the drive-side roller 34*a* with the recording paper 10 therebetween. The drive-side roller 34*a* is rotationally driven by a feed motor 34*c* disposed behind the roll paper holding tray 7*b* of the roll paper storage unit 8. The pressure roller 34*b* is attached to the distal end part of the pressure lever 35*c* that extends back diagonally from the bottom side of the platen unit 8. The pressure lever 35*c* is urged down by the force of a spring not shown, and the pressure roller 34*b* is pushed to the drive-side roller 34*a* side.

The feed roller pair 34 suppresses variation in the transportation load of the transportation roller pair 31 caused by variation in the pulling tension on the recording paper 10 when, for example, the recording paper 10 is conveyed by the transportation roller pair 31. For example, driving the feed roller pair 34 is controlled according to the vertically displaced position of the tension guide 33, and the recording paper 10 is fed so that the pulling tension on the recording paper 10 does not exceed a specified value. In other words, the feed roller pair 34 functions as a load variation suppression unit that suppresses variation in the transportation load of the recording paper 10 on the transportation roller pair 31.

A recording paper cutting mechanism 36 is disposed in front of the downstream guide surface 23 of the platen unit 8. The recording paper cutting mechanism 36 includes a fixed knife 36*a* that is disposed widthwise to the printer with the cutting edge facing up, a movable knife 36*b* that is disposed widthwise to the printer with the cutting edge facing down, and a drive unit 36*c* that causes the movable knife 36*b* to move to the fixed knife 36*a* side. The fixed knife 36*a* is disposed on the platen unit 8 side, and the movable knife 36*b* and drive unit 36*c* are disposed on the printer frame 11 side.

The recording paper 10 that is fed from the roll paper 9 loaded in the roll paper storage unit 7 is conveyed through the recording paper transportation path A indicated by the dot-dash line in FIG. 3. More specifically, after passing between the feed roller pair 34 and being pulled diagonally upward, the recording paper 10 travels around the tension guide 33 and curves toward the front of the printer, and reaches the nipping part 31*c* of the transportation roller pair 31. After passing the nipping part 31*c*, the recording paper 10 is conveyed from the upstream guide surface 21 passed the platen surface 22 defining the printing position and along the downstream guide surface 23. The recording paper 10 then passes between the fixed knife 36*a* and movable knife 36*b* of the recording paper cutting mechanism 36, is pulled out to the front of the printer, and is discharged from the paper exit 4 to the front.

The recording paper 10 is conveyed while held by air suction to the platen surface 22 that defines the printing position. The inkjet head 13 that moves bidirectionally widthwise to the printer prints on the surface of the recording paper 10 passing the printing position. After printing a line widthwise to the recording paper 10 ends, the transportation roller pair 31 and feed roller pair 34 are rotationally driven and the recording paper 10 is advanced only a specific pitch. The next line is then printed. The printed recording paper 10 is then fed towards the paper exit 4, and the cutting position of the recording paper 10 is positioned to the cutting position of the fixed knife 36*a* and movable knife 36*b* and cut. The cut-off part of the recording paper may then be issued as a receipt or ticket, for example.

As described above, the tension guide 33, the drive-side roller 31*a* of the transportation roller pair 31, the pressure lever 35*c* and the pressure roller 34*b*, and the fixed knife 36*a* of the recording paper cutting mechanism 36 are disposed to the platen unit 8. Therefore, when the access cover 3 is opened, the platen unit 8 linked thereto also moves from the closed position 8A shown in FIG. 3 to the open position 8B shown in FIG. 2. As a result, the recording paper transportation path A from the roll paper storage unit 7 to the paper exit 4 opens. Therefore, when the roll paper 9 is placed on the roll paper holding tray 7*b* of the roll paper storage unit 7, a specific length of recording paper 10 is pulled out, and the access cover 3 is closed, the recording paper 10 is automatically threaded through the recording paper transportation path A.

Note that an insertion unit 38*a* for fanfold paper is formed behind the head unit 12 in the roll paper printer 1 according to this embodiment of the invention. A guide panel mounting unit 38*b* is disposed to this insertion unit 38*a* so that a paper guide for fanfold paper not shown can be removably attached thereto. When this paper guide is installed, the transportation path that guides recording paper 10 through the tension guide 33 from the roll paper storage unit 7 side to the nipping part 31*c* of the transportation roller pair 31 is closed off, a transportation path for fanfold paper inserted from the back side of the printer is formed, and printing on fanfold paper that is fed through here from the back side of the printer is possible.

Figure 4:
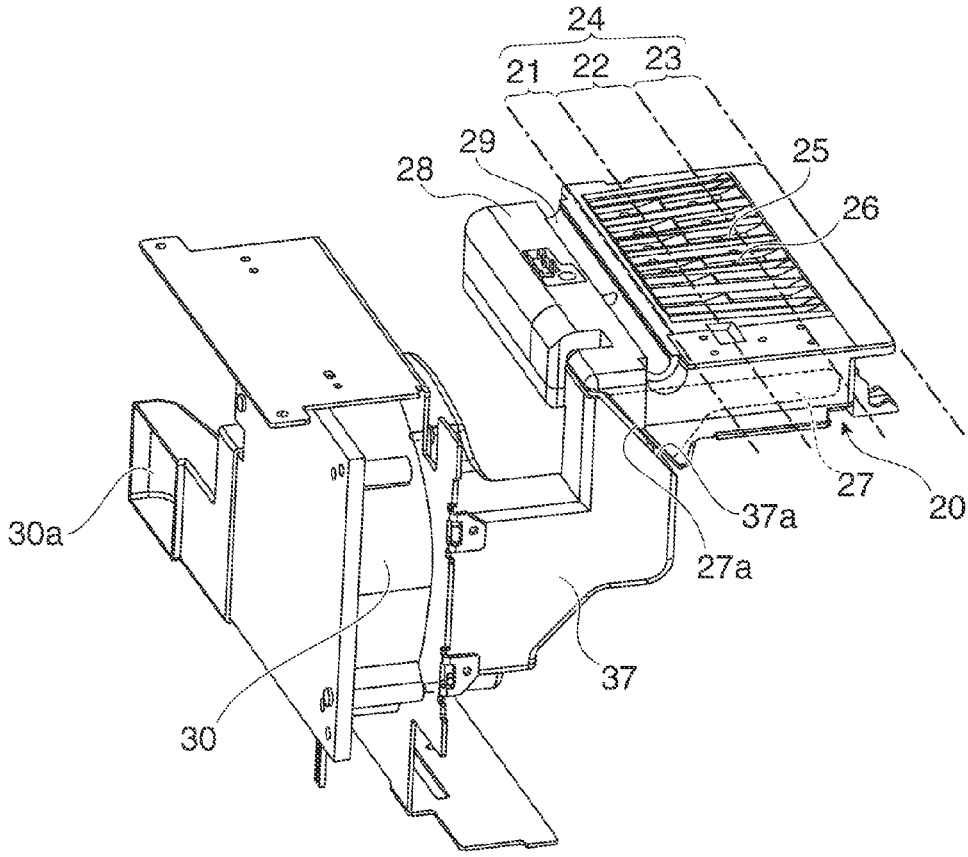
FIG. 4 is an oblique view showing the vacuum unit portion of the roll paper printer.

Next, FIG. 4 shows the part of the recording paper guide mechanism that guides the recording paper 10 along the guide surface 24 of the platen member 20 while holding the recording paper 10 thereto by means of air suction. The platen member 20 of the platen unit 8 has a generally flat, rectangular shape, and the guide surface 24 formed on the top is rendered by the top surfaces of a plurality of longitudinal ribs 25 that extend substantially in the recording paper transportation direction with a specific gap therebetween. Suction holes 26 of a specific size are formed at a specific interval in the bottom of the channels between the longitudinal ribs 25. The suction hole 26 is connected through a communication path 27 formed inside the platen member 20 to a rectangular communication opening 27*a* formed at one widthwise end at the back end part of the platen member 20.

The communication opening 27*a* is disconnectably connected to the intake opening 37*a* of a vacuum duct 37 attached to the printer case 2 side. The vacuum duct 37 is connected to the intake side of the centrifugal fan 30 disposed at the back side of the printer. The exhaust opening 30*a* of the centrifugal fan 30 opens from the back side of the printer. When the centrifugal fan 30 is driven, air is pulled through each suction hole 26 in the guide surface 24 of the platen member 20.

Therefore, the recording paper 10 conveyed over the guide surface 24 is applied and held flat to the top surface of each of the longitudinal ribs 25.

Note that the platen unit 8 also opens when the access cover 3 opens as will be understood from FIG. 2, and the communication opening 27*a* of the platen member 20 separates from the intake opening 37*a* of the vacuum duct 37 on the printer case side. When the access cover 3 is closed, the communication opening 27*a* is connected and pressed to the intake opening 37*a*, and the air suction path is formed.

Figure 5:
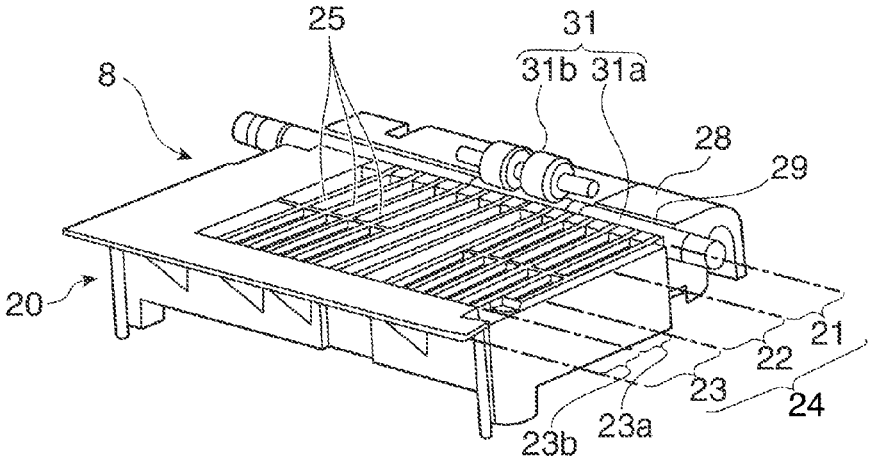
FIG. 5 is an oblique view showing the platen member of the roll paper printer.
Figure 6:
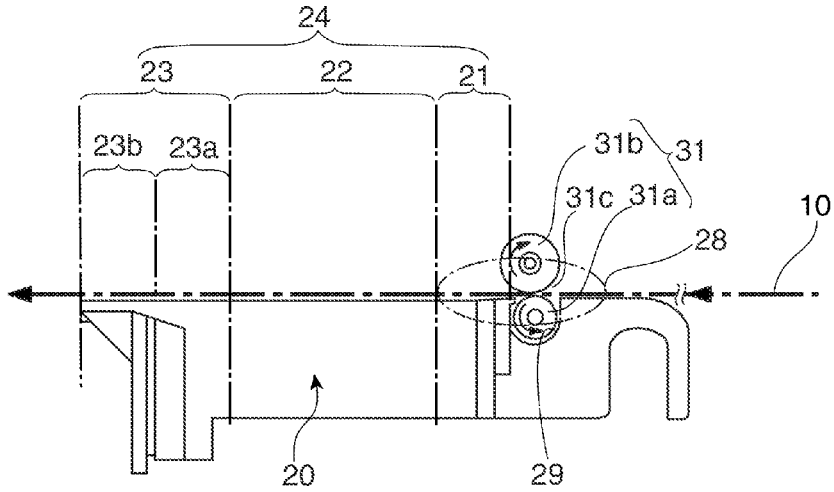
FIG. 6 is a side view of the platen member of the roll paper printer.
Figure 7:
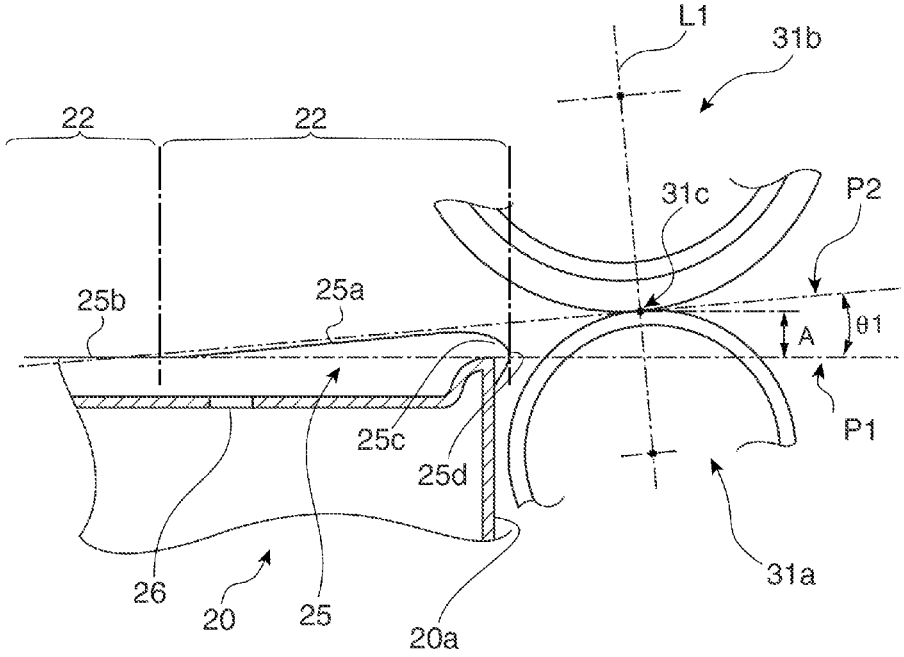
FIG. 7 shows a part of FIG. 6 enlarged.

FIG. 5 is an oblique view showing the platen member 20 and the transportation roller pair 31, and FIG. 6 is a side view thereof. FIG. 7 is a partial enlarged view showing the nipping part 31*c* part of the transportation roller pair 31. The guide surface 28 that receives the recording paper 10 from the tension guide 33 and a semicircular recessed channel 29 in which the drive-side roller 31*a* of the transportation roller pair 31 is disposed are formed at the end part on the upstream side in the recording paper transportation direction at the top of the platen member 20. The guide surface 24 that guides the recording paper 10 while pulling air therethrough is formed on the downstream side of the recessed channel 29.

As described above, the guide surface 24 is a surface having the upstream guide surface 21, the platen surface 22, and the downstream guide surface 23 formed contiguously to each other on substantially the same plane. The platen surface 22 part of the guide surface 24 is the part opposite the ink nozzle surface 13*a* of the inkjet head 13, and is the part of the width corresponding to the width of the ink nozzle surface 13*a* in the recording paper transportation direction.

As will be known from FIG. 7, the nipping part 31*c* of the transportation roller pair 31 is at a position offset height A above the horizontal plane P1 where the flat platen surface 22 that extends horizontally in the front-back direction of the printer is positioned. In addition, the pressure roller 31*b* of the transportation roller pair 31 is disposed to a position offset slightly to the front of the printer from the drive-side roller 31*a*, and the line segment L1 connecting the centers 31B and 31A is inclined with the top thereof leaning slightly to the front of the printer. As a result, the feed direction of the recording paper 10 advanced from the nipping part 31*c*, that is, the contact plane P2 of the round outside surface of the rollers 31*a*, 31*b* passing through the nipping part 31*c*, is an inclined plane that slopes angle θ1 from the nipping part 31*c* to the platen surface 22 in a direction approaching the platen surface 22.

The top surface 25*b* of the part of the longitudinal ribs 25 defining the platen surface 22 is a horizontal top surface positioned on the horizontal plane P1. The inclined top surface 25*a* of the part of the longitudinal ribs 25 defining the upstream guide surface 21 that is contiguous to the upstream side of the platen surface 22 is an inclined top surface that rises to the upstream side (as it approaches the nipping part 31*c*). This inclined top surface 25*a* is an inclined surface with a slope substantially equal to the inclination angle θ1 of the contact plane P2, which is the direction in which the recording paper 10 is fed from the nipping part 31*c*.

The upstream end part of each of the longitudinal ribs 25 of the upstream guide surface 21 is a protruding rib part 25*c* that protrudes more to the nipping part 31*c* side than the upstream-side end face 20*a* of the platen member 20, and the top surface thereof renders a curved up-lifting surface part 25*d* that is contiguous to the inclined top surface 25*a* and descends from the top.

When the part of the recording paper 10 fed from the nipping part 31*c* of the transportation roller pair 31 is conveyed along the contact plane P2, it is immediately guided onto the inclined top surface 25*a* of the longitudinal ribs 25 defining the upstream guide surface 21. Because this inclined top surface 25*a* inclines in the direction of the contact plane P2, the part of the recording paper 10 fed from the nipping part 31*c* is guided and held flat without buckling.

The upstream guide surface 21 is a vacuum guide surface, and the recording paper 10 is guided to the platen surface 22 while being pulled and held to the inclined top surface 25*a* of the longitudinal ribs 25 through the suction hole 26. The recording paper 10 is therefore guided in a flat condition with deflection in the out-of-plane direction (vertically as seen in FIG. 7) suppressed. As a result, the recording paper 10 is reliably conveyed to the platen surface 22 by the applied transportation force without buckling as a result of the transportation force of the transportation roller pair 31 applied from the upstream side. In other words, disruption of the transportation speed of the recording paper 10 conveyed to the platen surface 22 due to deflection of the recording paper 10 can be prevented, and the recording paper 10 can be fed to the platen surface 22 using only the transportation force of the single transportation roller pair 31 on the upstream side.

Next, because the platen surface 22 is also a vacuum type guide surface, the recording paper 10 conveyed along the platen surface 22 is held flat to the platen surface 22 by air suction. The platen gap can therefore be held constant. In addition, because buckling of the recording paper is suppressed, disruption of the recording paper 10 transportation speed due to slack in the recording paper 10 can be prevented, and the recording paper 10 can be fed along the platen surface 22 by only the transportation force of the single transportation roller pair 31 on the upstream side.

Next, the part of the recording paper 10 that has passed over the platen surface 22 and is printed by the inkjet head 13 is guided toward the paper exit 4 on the downstream side by the downstream guide surface 23 contiguous to the downstream side of the platen surface 22. The downstream guide surface 23 includes a flat vacuum type guide surface part 23*a* positioned on the same plane as the platen surface 22, and a flat guide surface part 23*b* that is contiguous to the guide surface part 23*a*. The printed part of the recording paper 10 is fed to the cutting position of the recording paper cutting mechanism while held flat by the downstream guide surface 23.

As described above, in a roll paper printer 1 according to this embodiment of the invention the recording paper 10 is conveyed downstream passed a printing position defined by a vacuum platen surface 22 by means of a single transportation roller pair 31 disposed on the upstream side of the platen surface 22 to the recording paper transportation path A that passes the printing position. Furthermore, so that the portion of the recording paper 10 fed from the nipping part 31*c* of the transportation roller pair 31 is conveyed without deflection to the platen surface 22, the recording paper 10 is guided from a near position on the downstream side (a position directly beside on the downstream side) of the nipping part 31*c* while being pulled and held to a vacuum type upstream guide surface 21 by air suction. The distance between the nipping part 31*c* and the upstream guide surface 21 is as short as possible without causing interference therebetween.

The part of the recording paper 10 that is fed from the nipping part 31*c* is held in a flat, deflection-suppressed condition by the vacuum type upstream guide surface 21. Therefore, even without a transportation roller disposed on the downstream side of the platen surface 22, the recording paper 10 can be delivered to the platen surface 22 without deflection of the recording paper 10 being caused by the transportation force applied to the recording paper 10 from the upstream side transportation roller pair 31. In addition, the recording paper 10 can be conveyed at a constant feed rate and amount along the platen surface 22.

KEY TO THE FIGURES

1 roll paper printer
2 printer case
2*a* outside case
3 access cover
4 paper exit
5 exit guide
6 cover opening lever
7 roll paper storage unit
7*a* opening
7*b* roll paper holding tray
8 platen unit
9 roll paper
10 recording paper
11 printer frame
12 head unit
13 inkjet head
13*a* ink nozzle surface
14 carriage
15 carriage guide shaft
20 platen member
21 upstream guide surface
22 platen surface
23 downstream guide surface
23*a*, 23*b* guide surface part
24 guide surface
25 longitudinal ribs
25*a* inclined top surface
25*b* top surface
25*c* protruding rib part
25*d* up-lifting surface part
26 suction hole
27 communication path
27*a* communication opening
28 guide surface
29 recessed channel
30 centrifugal fan
30*a* exhaust opening
31 transportation roller pair
31*a* roller
31*b* pressure roller
31*c* nipping part
32 transportation motor
33 tension guide
34 feed roller pair
34*a* roller
34*b* pressure roller
34*c* feed motor
35*c* pressure lever
36 recording paper cutting mechanism
36*a* fixed knife
36*b* movable knife
36*c* drive unit
37 vacuum duct
37*a* intake opening
38*a* insertion unit
38*b* guide panel mounting unit
P1 horizontal plane
P2 contact plane
θ1 inclination angle

The invention claimed is:

1. A printer comprising:

an inkjet head having an ink nozzle surface facing in a downward direction;

a transportation roller pair disposed at a position on an upstream side in a recording paper transportation direction from a printing position of the inkjet head that forms a nipping part between a first roller and a second roller disposed on a lower side of the first roller;

a platen member having a guide surface that guides a recording paper and on which a plurality of ribs extend in the recording paper transportation direction and suction holes are formed, wherein the platen member includes an upstream-side end face opposite the second roller; and a vacuum unit that produces negative pressure for drawing air through suction holes, wherein the guide surface is formed by, a platen surface defined by a top surface of the ribs opposite the ink nozzle surface, and an upstream guide surface defined by the top surface of the ribs, wherein the upstream guide surface contiguous to the upstream side of the platen surface is an inclined surface that is inclined as it approaches the nipping part, wherein an upstream end part of the ribs protrude upstream from the upstream-side end faces towards the nipping part, and wherein the nipping part is a position offset height above a plane that extends along the platen surface.

2. The printer described in claim 1, wherein a recessed channel on the upstream side extending across the recording paper transportation direction and formed within the platen, wherein the second roller of the transportation roller pair is disposed within the recessed channel.

3. The printer described in claim 1, further comprising:

a roll paper storage unit having a roll paper holding tray on which roll paper composed of a continuous web of recording paper wound in a roll is placed so that the roll paper can rotate, the recording paper being pulled by the transportation roller pair while the roll paper rolls on the roll paper holding tray.

4. The printer described in claim 3, further comprising:

a load variation suppression unit that moves according to variation in a pulling tension on the recording paper pulled from the roll paper.

5. The printer described in claim 3, wherein the platen surface is a horizontal plane, and the upstream guide surface is the inclined surface with a slope substantially equal to an inclination angle of a contact plane of a round outside surface of the first roller and the second roller passing through the nipping part.

* * * * *